US009243578B2

(12) United States Patent
Cleeves et al.

(10) Patent No.: US 9,243,578 B2
(45) Date of Patent: Jan. 26, 2016

(54) DECELERATION FUEL SHUT OFF FOR CARBURETED ENGINES

(71) Applicants: James M. Cleeves, Redwood City, CA (US); Michael Hawkes, San Francisco, CA (US)

(72) Inventors: James M. Cleeves, Redwood City, CA (US); Michael Hawkes, San Francisco, CA (US)

(73) Assignee: Pinnacle Engines, Inc., San Carlos, CA (US)

( * ) Notice: Subject to any disclaimer, the term of this patent is extended or adjusted under 35 U.S.C. 154(b) by 328 days.

(21) Appl. No.: 13/937,964

(22) Filed: Jul. 9, 2013

(65) Prior Publication Data

US 2014/0158093 A1 Jun. 12, 2014

Related U.S. Application Data

(60) Provisional application No. 61/669,590, filed on Jul. 9, 2012.

(51) Int. Cl.

| | |
|---|---|
| ***F02D 41/30*** | (2006.01) |
| ***F02D 41/12*** | (2006.01) |
| ***F02M 3/045*** | (2006.01) |
| ***F02D 35/00*** | (2006.01) |
| ***F02M 37/00*** | (2006.01) |

(52) U.S. Cl.

CPC ..... *F02D 41/30* (2013.01); *F02D 35/0053* (2013.01); *F02D 41/123* (2013.01); *F02M 3/045* (2013.01); *F02M 37/0023* (2013.01); *F02D 2200/0404* (2013.01); *F02D 2400/06* (2013.01)

(58) Field of Classification Search

CPC ..... F02D 41/00; F02D 41/30; F02D 14/123; F02D 2200/0409; F02M 3/045; F02M 37/0023

See application file for complete search history.

(56) References Cited

U.S. PATENT DOCUMENTS

| | | | | | |
|---|---|---|---|---|---|
| 2,679,835 | A | * | 6/1954 | Thorner | F02D 9/00 123/437 |
| 3,327,694 | A | | 6/1967 | Hajime | |
| 3,682,148 | A | * | 8/1972 | Harrison | F02M 3/04 123/198 D |
| 4,008,696 | A | | 2/1977 | Hisatomi | |
| 4,253,437 | A | | 3/1981 | Haramoto | |
| 4,269,062 | A | * | 5/1981 | Smitley | F02M 19/01 261/41.5 |
| 4,434,414 | A | | 2/1984 | Bell et al. | |
| 4,903,659 | A | * | 2/1990 | Inagaki | F02D 31/003 123/339.17 |

FOREIGN PATENT DOCUMENTS

| | | | |
|---|---|---|---|
| DE | 1266034 | B | 4/1968 |
| GB | 660820 | A | 11/1951 |
| GB | 1326723 | A | 8/1973 |
| GB | 2086484 | A | 5/1982 |

OTHER PUBLICATIONS

PCT Search Report dated Feb. 17, 2014 for PCT application No. PCT/US2013/049752.

* cited by examiner

*Primary Examiner* — Hieu T Vo

(74) *Attorney, Agent, or Firm* — Mintz Levin Cohn Ferris Glovsky and Popeo, P.C.

(57) ABSTRACT

Fuel efficiency of small carbureted engines can be improved through the use of a fuel shut off valve that ceases fuel flow in the carburetor upon determination that the engine throttle has been closed and the engine is not at or near an idle condition.

22 Claims, 5 Drawing Sheets

DECELERATION FUEL SHUT OFF FOR CARBURETED ENGINES

CROSS-REFERENCE TO RELATED APPLICATION

This application claims priority to U.S. Provisional Application No. 61/669,590, which was filed on Jul. 9, 2013. The disclosure of the priority application and any other documents referenced herein are incorporated by reference to the extent possible under applicable laws unless otherwise stated.

TECHNICAL FIELD

The subject matter described herein relates to shut off or cut off of fuel delivery to an internal combustion engine, for example during a period of engine braking when an operator has released the throttle control while leaving the transmission of a vehicle engaged.

BACKGROUND

Conventional carbureted engines used in motor vehicles, particularly those used in many motorcycles, generally do not have shut off valves to allow turning the fuel flow off when the motor vehicle is decelerating.

Real-world and simulated drive cycles representative of how motorcycles are used generally include a significant amount of time spent decelerating with the throttle closed on the carburetor. Such periods can include the use of so-called engine braking, in which the operator releases the throttle control and the throttle valve closes to prevent air from flowing into the combustion chamber(s) of the engine. Any fuel that is delivered to the combustion chamber(s) of the engine during periods in which the throttle is closed in this manner is generally wasted.

SUMMARY

In one aspect, a system includes at least one sensor for detecting an idle condition and a throttle closed condition for an internal combustion engine. The system also includes a fuel shut off valve for shutting off fuel flow to a carburetor of the internal combustion engine when the throttle closed condition occurs without the idle condition and for allowing fuel flow to the carburetor when either the throttle closed condition is not present or the idle condition is present.

In an interrelated aspect, a method includes detecting an engine throttle closed condition for an internal combustion engine; determining whether an idle condition is present in the internal combustion engine; activating a fuel shut-off valve to cease fuel flow when engine throttle closed condition exists and the idle condition is not present; and deactivating the fuel shut-off valve to resume fuel flow when either the idle condition is present or the engine throttle closed condition does not exist.

In some variations, one or more of the following features can optionally be included in any feasible combination. The at least one sensor can include a first sensor for detecting the idle condition and a second sensor for detecting the throttle closed condition. The first sensor for detecting the idle condition can include a sensing inductor positioned to react to current flowing through one or more ignition wires of the internal combustion engine, a diode that receives and converts output from the sensing inductor to a unidirectional current, a charge storage device that receives and stores a charge generated by the unidirectional current, and a transistor having a turn-on threshold that is exceeded by voltage on the charge storage device when a speed of the internal combustion engine is at or above a threshold engine speed indicative of the internal combustion engine not being at idle. The second sensor can include a binary throttle switch that indicates on when the throttle is closed and indicates off when the throttle is open. A bleed resistor can be included and tuned to cause the voltage on the charge storage device to track the engine speed. The bleed resistor can include a variable resistance such that the threshold engine speed is adjustable.

The first sensor and the second sensor can arranged in series such that when the speed of the internal combustion engine is at or above the threshold engine speed, thereby causing the transistor to be turned on, and when the throttle is closed, thereby causing the binary throttle switch to indicate on, current is provided to a solenoid of the fuel shut off valve to cause the fuel shut off valve to interrupt a supply of fuel to the combustion chamber. Additionally, when the speed of the engine decreases below the threshold engine speed, or when the throttle is opened, or when the speed of the engine decreases below the threshold engine speed and the throttle is opened, the current to the solenoid is stopped and the fuel shut off valve no longer interrupts the supply of fuel.

The at least one sensor can include a pressure sensor. The pressure sensor can detect a pressure drop in an intake manifold of the internal combustion engine. Such a pressure drop occurs once per engine cycle for each combustion chamber in the internal combustion engine (e.g. once per revolution per combustion chamber for a two stroke engine and once per two revolutions per combustion chamber for a four stroke engine) when the throttle is closed. The pressure sensor can thereby provide a measure of engine speed and a detection of the throttle closed condition. The measure of engine speed can be used to detect the idle condition.

The at least one sensor can include a vacuum-driven diaphragm positioned to have atmospheric pressure on a first side and intake manifold pressure on a manifold side opposite to the first side. The diaphragm can include a bleed hole on the manifold side to tune the diaphragm such that the diaphragm actuates above a threshold engine speed indicative of the idle condition not being present. Actuation of the diaphragm can cause the fuel shut off valve to shut off the fuel flow to the carburetor. The diaphragm can include a linkage to a throttle of the internal combustion engine such that actuation of the diaphragm to cause the fuel shut off valve to shut off the fuel flow to the carburetor is allowed only with the throttle closed condition.

The fuel shut off valve can include a heater and a bimetallic element. The bimetallic element can include a flat side arranged so that the flat side is directed toward incoming air flow in the carburetor. The heater can provide heat to the bimetallic element to cause the bimetallic element to straighten to cover a fuel orifice in the carburetor. Current to the heater can be turned on when the throttle closed condition occurs without the idle condition, thereby interrupting a flow of fuel, and turned off when at least one of the throttle closed condition is not present or the idle condition is present, thereby resuming the flow of fuel.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The details of one or more variations of the subject matter described herein are set forth in the accompanying drawings and the description below. Other features and advantages of the subject matter described herein will be apparent from the description and drawings, and from the claims. The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Many industrial engines, for example those used in devices such as lawn and garden equipment, are equipped with valves that stop the flow of fuel to the engine when the engine ignition is shut off. This approach can limit the emissions from unburned fuel after shut down of a carbureted engine. However, almost no control logic or dynamic feedback is used in such engines. If the engine is running, fuel is allowed to flow, and if the engine is stopped or in the process of stopping after ignition shut-off, no fuel is allowed to flow.

Consistent with implementations of the current subject matter, fuel consumption in a carbureted engine, such as for example an engine used to power a motorcycle or other vehicle, can be reduced through the use of one or more valves to cease fuel flow to the combustion chamber of an engine when an operator closes the throttle at speeds above idle, and to resume fuel flow before the engine decelerates back to idle speed. For simplicity and clarity, the singular term "fuel shut-off valve" is used in this disclosure to refer either to a single valve or to multiple valves that accomplish the objective of ceasing the flow of fuel into one or more combustion chambers of an internal combustion engine.

As an example, the operator might close the throttle when the engine is operating at a speed of 4000 RPM (revolutions per minute) such that deceleration of the engine (and the vehicle) begins. Fuel flow is shut off upon closing of the throttle. As the engine speed (and also that of the vehicle) slows and the engine speed drops, fuel flow can be maintained in a non-flow condition until a threshold engine speed, such as for example approximately 2000 RPM. When the engine decelerates to less than the threshold speed, fuel flow can be resumed such that as the engine slows to an idle speed (e.g. approximately 1500 rpm for a relatively small motorcycle engine), fuel flow remains sufficient to support a stable idle condition.

Figure 1:
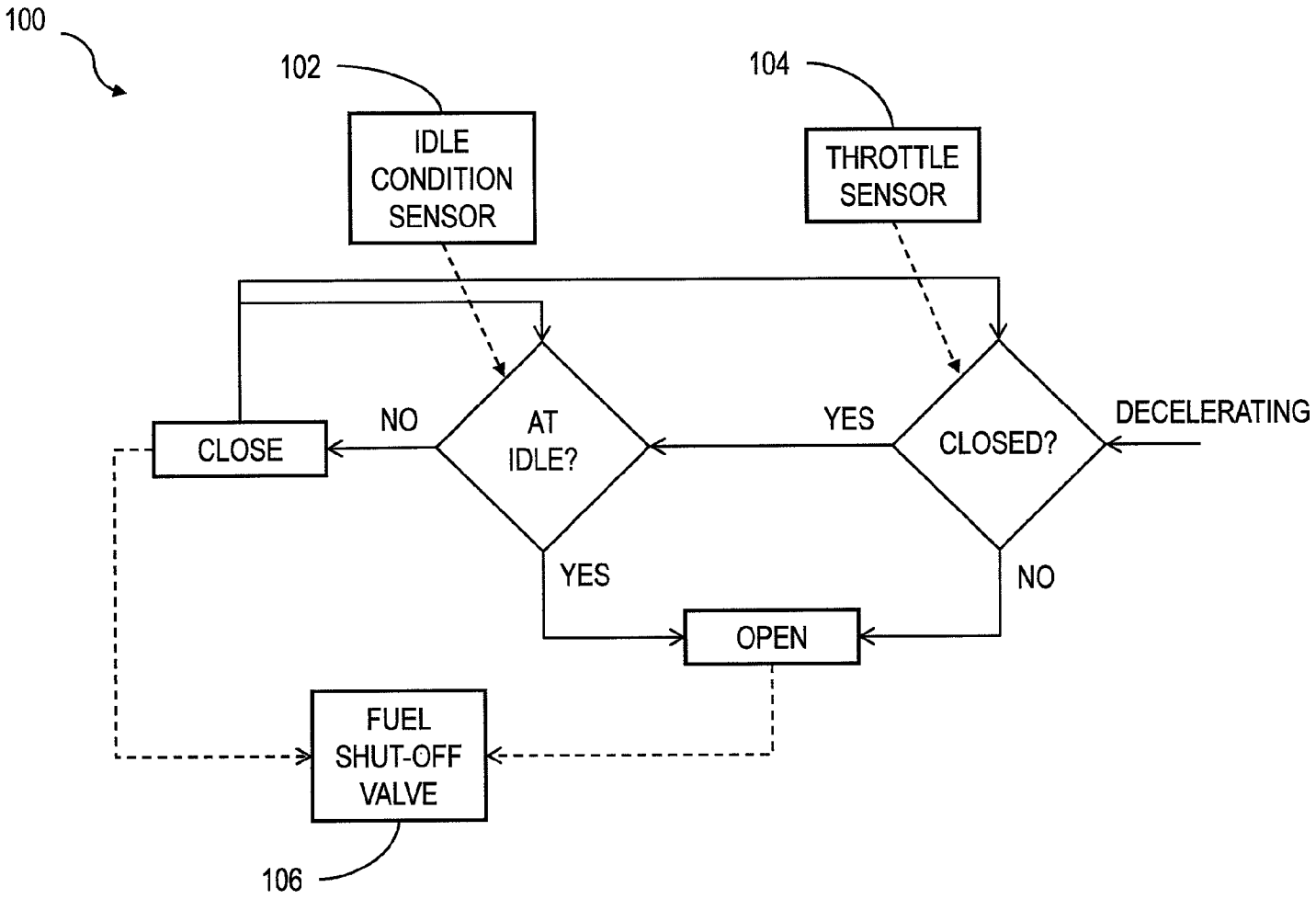
FIG. 1 shows a diagram illustrating aspects of a system showing features consistent with implementations of the current subject matter.

As shown in FIG. 1, an idle condition sensor 102 or other device, system, or comparable means of determining whether an idle ignition timing is currently in effect can, in some implementations of the current subject matter, be used in combination with a throttle position sensor 104 or other means of determining whether the throttle of an engine is currently open or closed.

The idle condition sensor 102 can apply one of a variety of approaches to determining whether the engine is currently in an idling state. For example, in some implementations of the current subject matter, the idle condition sensor 102 can detect an idle condition using one or more of reading an idle status pin (e.g. if ignition timing is controlled electronically, for example by an engine control unit or ECU), detecting an idle timing condition, determining a current speed of the engine that is within a range defined to be consistent with an idle condition, or the like.

The throttle position sensor 104 can be, in some implementations of the current subject matter, as simple as a switch that changes state when the throttle is closed. The change of state can be a change from an open state to a closed state or from a closed state to an open state. A switch in a closed state is one that creates a closed circuit, thereby allowing a control signal (e.g. a control voltage or current or the like) to flow, while a switch in an open state is one in which a signal cannot flow. In more complex engines using electronic control (e.g. from an ECU), a current throttle condition (e.g. closed or not closed) can register as a signal from the ECU or other electronic control unit.

A fuel shut-off valve 106 can be triggered to prevent fuel from flowing to the combustion chamber(s) of an engine according to a current status of both of an idle ignition setting and a throttle position setting, which can be determined using the idle condition sensor 102 and the throttle position sensor 104. Some potential examples of an idle condition sensor 102 and a throttle sensor 104 are discussed below. The idle condition sensor 102 and the throttle sensor 104 can be programmed or otherwise arranged logically in series. When the engine is not at idle and the throttle is closed, the fuel shut-off valve 106 can be closed, for example by causing power to flow to a solenoid valve that controls the fuel flow. The fuel shut-off valve 106 can remain closed until either the throttle re-opens as detected by the throttle sensor or the engine achieves an idle state as detected by the idle condition sensor 102. In some implementations of the current subject matter, both of the idle condition sensor 102 and the throttle sensor 104 can be transistors that are triggered on or off depending on the status of the idle setting and the throttle condition, respectively. Such transistors can be controlled with very little power (e.g. less than the operating current needed for a solenoid on the fuel shut-off valve 106 as each can serve merely as a voltage gate.

Figure 2:
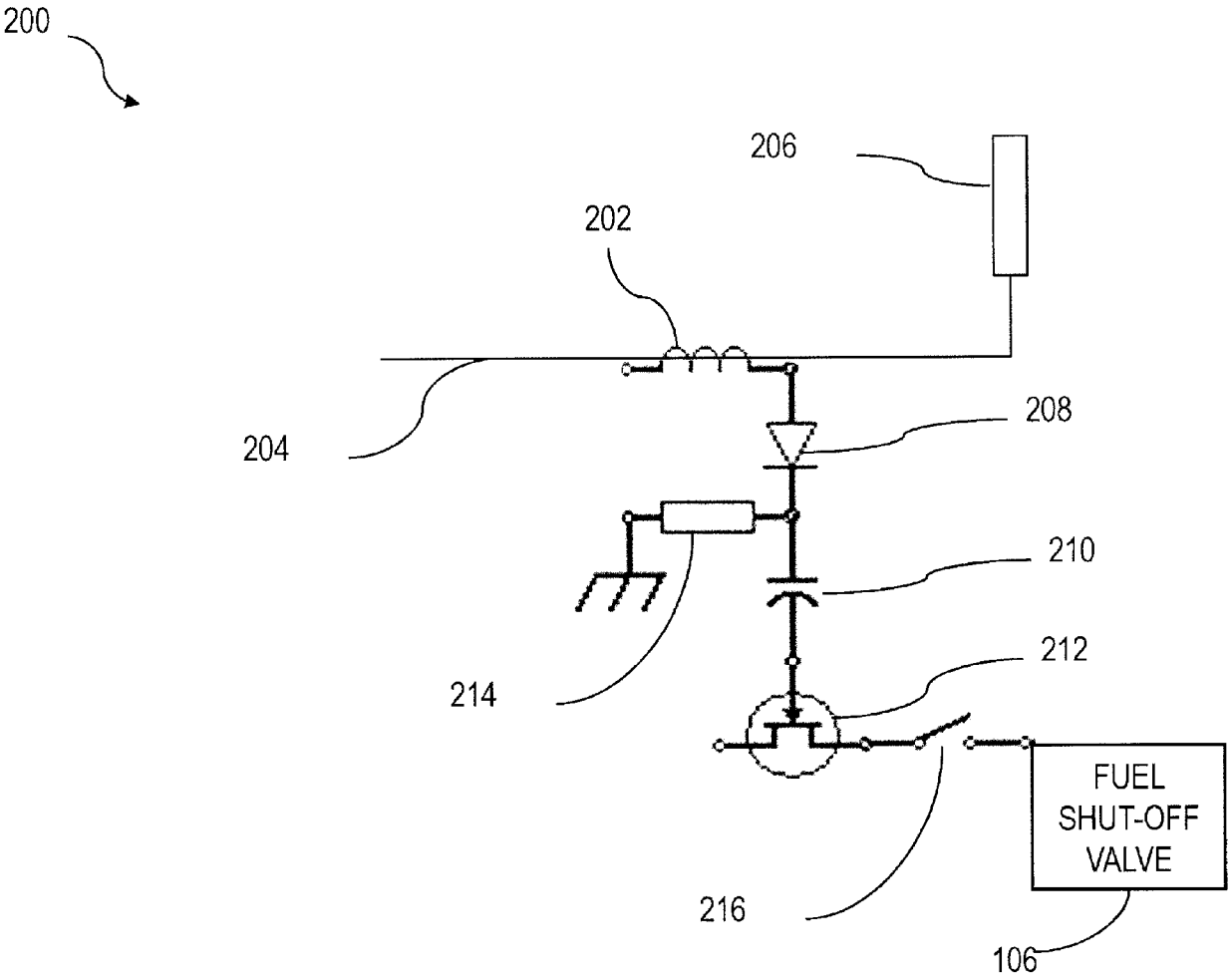
FIG. 2 shows a diagram illustrating aspects of another system showing features consistent with implementations of the current subject matter.

In some engine designs, there may be no ignition controller to provide an idle signal. In such cases, a system 200 such as that illustrated in FIG. 2 can be used. As shown in FIG. 2, an idle condition sensor 102 can include a sensing inductor 202, which can be positioned to react to current flowing through one or more ignition wires 204 carrying ignition current to one or more ignition sources 206 (e.g. spark plugs in the combustion chamber(s) of the engine). In one example, the sensing inductor can be wrapped around the one or more ignition wires 204. An example of such an ignition wire 204 can include, but is not limited to, either or both of a primary and a secondary spark plug wire. The frequency or the strength of the intermittent current through the one or more ignition wires 204 can be proportional to the speed of the engine. Accordingly, a diode 208 can be used to receive the output of the sensing inductor 202 and to convert the resulting inducted current to a unidirectional current. A charge storage device 210, such as for example a capacitor, can store the charge generated by the unidirectional current from the diode

208. When the voltage generated by the diode and stored by the charge storage device 210 exceeds a "turn-on" threshold for a transistor 212, the transistor 212 is turned on. A bleed down resistor 214 can ensure that the voltage on the charge storage device 210, and hence the gate of the transistor 212, tracks the engine speed closely. The bleed down resistor 214 and the charge storage device 210 can be tuned to cause the transistor 212 to turn on at some threshold engine speed (e.g. several hundred revolutions per minute of RPM) above idle speed and to remain on as the speed rises.

Such an idle-detecting transistor 212 can be arranged in series with a throttle sensor, which can simply be a binary throttle switch 216 that indicates on when the throttle is closed and indicates off when the throttle is open. When the throttle switch 216 indicates on (i.e. the throttle is closed) and the sensing inductor 202 has activated the idle-detecting transistor 212, current to a solenoid of the fuel shut off valve 106 can be switched on so that fuel flow to the combustion chamber(s) of the engine is interrupted. When the status of either of the idle-detecting transistor 212 or the throttle switch 216 changes, current to the solenoid of the fuel shut off valve 106 is interrupted and the fuel shut off valve 106 is opened to resume the flow of fuel to the combustion chamber(s).

Alternative configurations of a deceleration fuel shut-off system are also consistent with implementations of the current subject matter. For example, other circuit implementations to achieve similar functions to those discussed herein are possible. In some implementations of the current subject matter, the bleed resistor 214 that is used to bleed the charge off the capacitor 210 can be variable such that the transition speed is adjustable for different motorcycles (or other vehicles) in different environments or under different use regimes. In other implementations, an engine control unit can monitor engine speed and a throttle condition and can activate a fuel shut off valve 106 as discussed above when the engine is above idle and the throttle is closed.

In still other implementations of the current subject matter, a pressure sensor can be used to determine both engine speed and throttle position, for example by detecting average manifold pressure as an indication of throttle position, and by detecting an intake pulse frequency to determine engine speed. A very distinct pressure drop can occur in an engine once per engine cycle for each combustion chamber of the engine when the throttle is closed. This pressure drop occurs due to the air inlet valve for the combustion chamber(s) opening to draw air from the intake manifold while the throttle is closed, thereby preventing a significant amount of additional air to enter the intake manifold to replenish the air drawn into the combustion chamber(s). As used herein, the term "engine cycle" refers to a complete thermodynamic cycle for a combustion chamber, including intake, compression, combustion, and exhaust. In a two-stroke engine, a complete engine cycle occurs for each full revolution of the crankshaft. For a four-stroke engine, a complete engine cycle occurs for each two revolutions of the crankshaft. Accordingly, for an engine with one combustion chamber, one pressure drop indicates one revolution of the crankshaft if the engine is a two stroke engine or two revolutions of the crankshaft if the engine is a four stroke engine. The number of combustion chambers in the engine in conjunction with the count of pressure drops detected in the intake manifold per unit time can thereby be used to determine engine speed.

Engine speed can be used as a proxy for determining whether an idle condition exists. For example, an engine speed within a defined idle range can be taken as an indication that the engine is in an idle condition and the fuel shut-off valve 106 should be deactivated to allow fuel to flow. Using a pressure sensor in this manner can satisfy both sensing requirements in one sensor. As an example, a microphone used as a pressure sensor or pressure transducer can replace the sensing inductor 202 in the system 200 of FIG. 2. In another example, a pressure sensor system can be implemented either with or without a throttle position sensor 104. An electrical activation can be provided to operate a solenoid valve or other valve mechanism associated with the fuel shut-off valve 106.

In still other implementations of the current subject matter, the fuel shut-off valve 106 can be operated in a non-electrical manner (e.g. a solenoid can be unnecessary). A vacuum-driven diaphragm can be tuned to actuate the fuel shut-off valve 106. The diaphragm can have atmospheric pressure on one side and manifold pressure (e.g. from the intake manifold of the engine) on the other. A small bleed hole can be provided on the manifold side to allow tuning the diaphragm response. Below a critical engine speed, which can optionally be a threshold sped below which an idle condition is assumed to exist (e.g. approximately 2000 RPM), the bleed hole can keep the pressure sufficiently high to prevent the fuel shut-off valve 106 from being actuated. Above the critical engine speed, the diaphragm can serve as a direct actuator for the fuel shut-off valve. Using this approach, a carburetor having one or more features consistent with implementations of the current subject matter can be provided as a "bolt-in" aftermarket replacement for a factory carburetor requiring no other modifications to the engine.

A diaphragm-operated fuel shut-off valve 106 can optionally be implemented with a linkage to the throttle that can alter the diaphragm function in response to throttle position such that the throttle closed condition can allow action of the diaphragm to activate the fuel shut-off valve 106 as discussed above. In such an implementation of the current subject matter, the diaphragm can directly operate the shutoff, and can thus remove a need for an electrically operated fuel shut-off valve 106 or for an electrical throttle position indicator. In some examples, a linkage or pneumatic switch can provide feedback from the throttle to the diaphragm operating the fuel shut-off valve 106. In still other implementations of the current subject matter, a diaphragm can be combined with an electrical system for activating the fuel shut-off valve 106.

Figure 3:
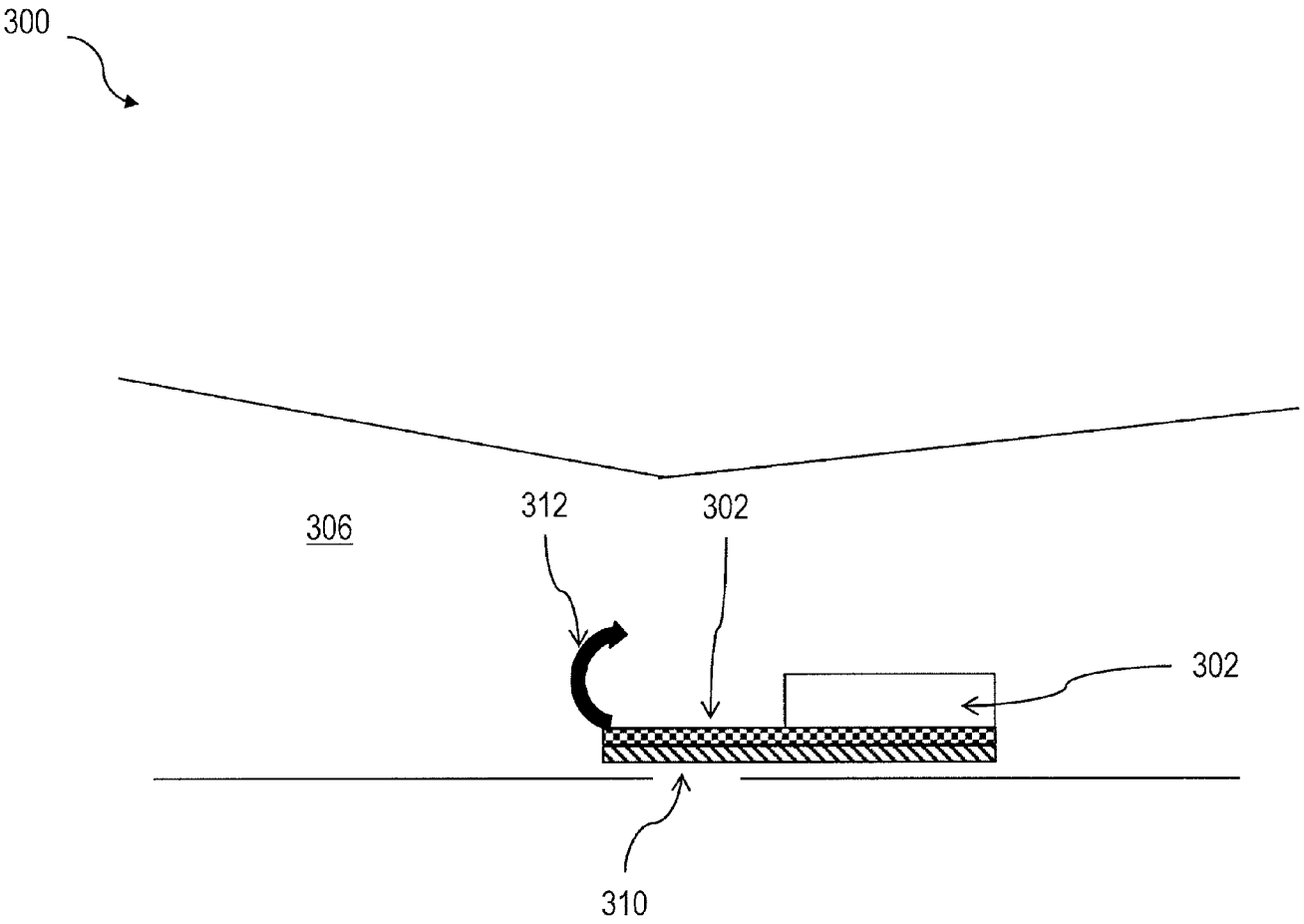
FIG. 3 shows a diagram of a fuel shut off valve that include a bimetallic element consistent with implementations of the current subject matter.

In another implementation of the current subject matter, a fuel shut-off valve 106 can include a heater 302 and a bimetallic element 304, such as for example as illustrated in the diagram 300 of FIG. 3. The bimetallic element 302 can be one that changes shape as it is heated or cooled. For example, the bimetallic element 304 can include a bimetallic finger, which can be an inexpensive solution relative to a solenoid valve, can be positioned in a throat region 306 of the engine air intake passage. A flat side of the bimetallic element 304 can be arranged so that it is directed toward the incoming airflow such that the bimetallic element 304 straightens to cover a fuel orifice 310 when heated by the heater 302. Air flowing through the air passage can rapidly cool the bimetallic element 304 to cause it bend (e.g. as shown by the arrow 312) when the heater current is off such that the fuel orifice 310 is uncovered to allow fuel to flow. Thus, one of the other approaches described herein can be used to provide or not provide current to the heater 302 depending on whether a throttle closed position and a non-idle condition occur simultaneously.

The fuel shut-off valve 106 can advantageously include features that reduce or perhaps even eliminate surging in the flow of fuel as the fuel shut-off valve 106 opens and closes. A closing element that causes a flat surface to be pushed against a seat is likely to push extra fuel out as it closes and to thereby cause such surges. It can be acceptable if this extra surge of fuel is pushed into the fuel reservoir from which fuel is distributed into the air flowing through a carburetor. However, if the surge of fuel is directed toward the fuel orifice through which the fuel flows from the fuel reservoir into the inlet air, the extra fuel will be run through the engine when none is desired. A sleeve-like sealing element can eliminate or reduce fuel surging and can therefore be advantageously used with the current subject matter.

Figures 4A, 4B, 4C:
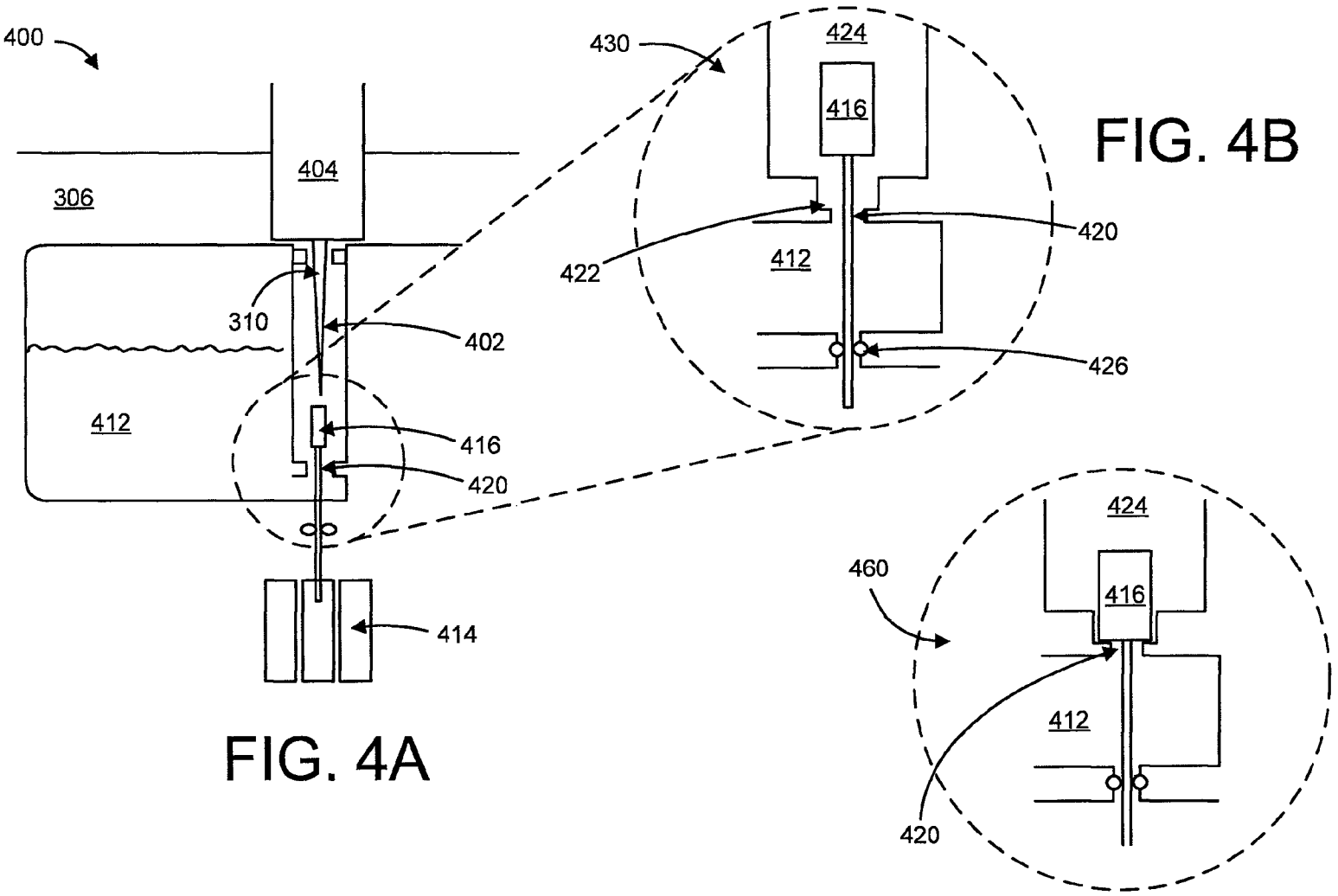
FIG. 4A, FIG. 4B, and FIG. 4C show diagrams of a fuel shut off valve including a displacement feature consistent with implementations of the current subject matter.

In some other implementations of the current subject matter, the fuel shut off valve 106 can advantageously include a certain amount of displacement, such a for example as illustrated in the diagrams 400, 420, and 430 of FIG. 4A, FIG. 4B, and FIG. 4C, respectively. As shown in FIG. 4A, a carburetor can include a needle 402 attached to an air flow control slide 404. The slide moves up and down to increase or decrease a cross sectional area for air flow within a throat region 306 of the carburetor. The needle 402 moves with the slide 404 such that a position of the needle 402 within a fuel orifice 310 varies. The needle 402 generally has a shape that varies along the length of the needle such that a different fraction of the cross-sectional area of the fuel orifice 310 is available for fuel to pass out of a fuel reservoir 412 into air flowing through the throat region 306 depending on a position of the needle 402. The needle 402 need not move in exactly the same manner as the slide 404. The amount of fuel passing from the fuel reservoir 412, in combination with an amount of air allowed to pass through the throat region 306 due to the position of the slide 404, produces a fuel-air mixture having a fuel-air ratio.

FIG. 4A also shows a solenoid 414, which can control motion of a fuel shut off valve consistent with implementations of the current subject matter. The use of a solenoid in this example is not intended to be limiting. Other mechanisms or structures for actuating a fuel shut off valve are also within the scope of the current subject matter. As shown in FIG. 4A, the solenoid 414 causes movement of a valve seal element 416 into and out of a port 420 to seal or unseal, respectively, the port 420 for fuel flowing through the port 420 from the fuel reservoir 412 to the fuel orifice 310 and out into the air moving through the throat region 306.

FIG. 4B shows a detail view 430 of the valve seal element 416 and the port 420 with the shut off valve open (e.g. with the solenoid not activated). The valve seal element 416 is moved up away from the port 420 and out of a seating volume 422. In doing so, the valve seal element 416, which can have a displacement volume that in non-negligible relative to a channel 424 that leads to the fuel orifice, can draw fuel from the fuel reservoir 412 into the seating volume to assist in rapidly re-filling the channel and to impart momentum in the direction of the orifice 310 to fuel already in the channel 424.

While the port 420 is depicted in FIG. 4A, FIG. 4B, and FIG. 4C as oriented beneath the valve seal element such that the valve seal element 416 moves downward to close the fuel shut off valve and upward to open the fuel shutoff valve, this is merely an illustrative example. In such a configuration, an o-ring or other sealing element 426 can be provided to allow a plunger element 430 to be mechanically connected to the valve seal element 416 and to the solenoid 414 while avoiding leakage of fuel from the fuel reservoir 412. In other examples in which the solenoid 414 is not positioned underneath the fuel reservoir 412, the use of an o-ring 426 or other sealing elements may not be necessary.

FIG. 4C shows a detail view of the valve seal element 416 and the port 420 with the shut off valve closed (e.g. with the solenoid activated). The valve seal element 416 is moved down toward the port 420 and into the seating volume 422. In doing so, the valve seal element 416, can push fuel back into the fuel reservoir 412 from the seating volume 422 and can also impart momentum away from the orifice 310 to fuel in the channel 424.

In the manner illustrated in FIG. 4A, FIG. 4B, and FIG. 4C or in other approaches consistent with the descriptions and claims herein, the fuel shut off valve 106 can cause fuel to be pushed back into the fuel reservoir 412 on closing of the fuel shut off valve and pulled back out again on opening of the fuel shut off valve. This effect can create a negative pressure when the fuel shut off valve 106 is activated, thereby providing a quicker response to either of closing of the throttle or turning off of the engine. When the throttle opens again, the positive pressure created by the resultant opening of the fuel shut off valve 106 can cause a small surge of fuel back into the channel 424 between the fuel shut off valve 106 and the fuel orifice. This surge can advantageously serve to refill the channel 424 quickly to replace fuel that could have evaporated out of the channel 424 during the deceleration period while the fuel shut off valve 106 was closed. This feature can also assist in stabilizing the engine as it approaches idle speed during the transition back to running again.

Figure 5:
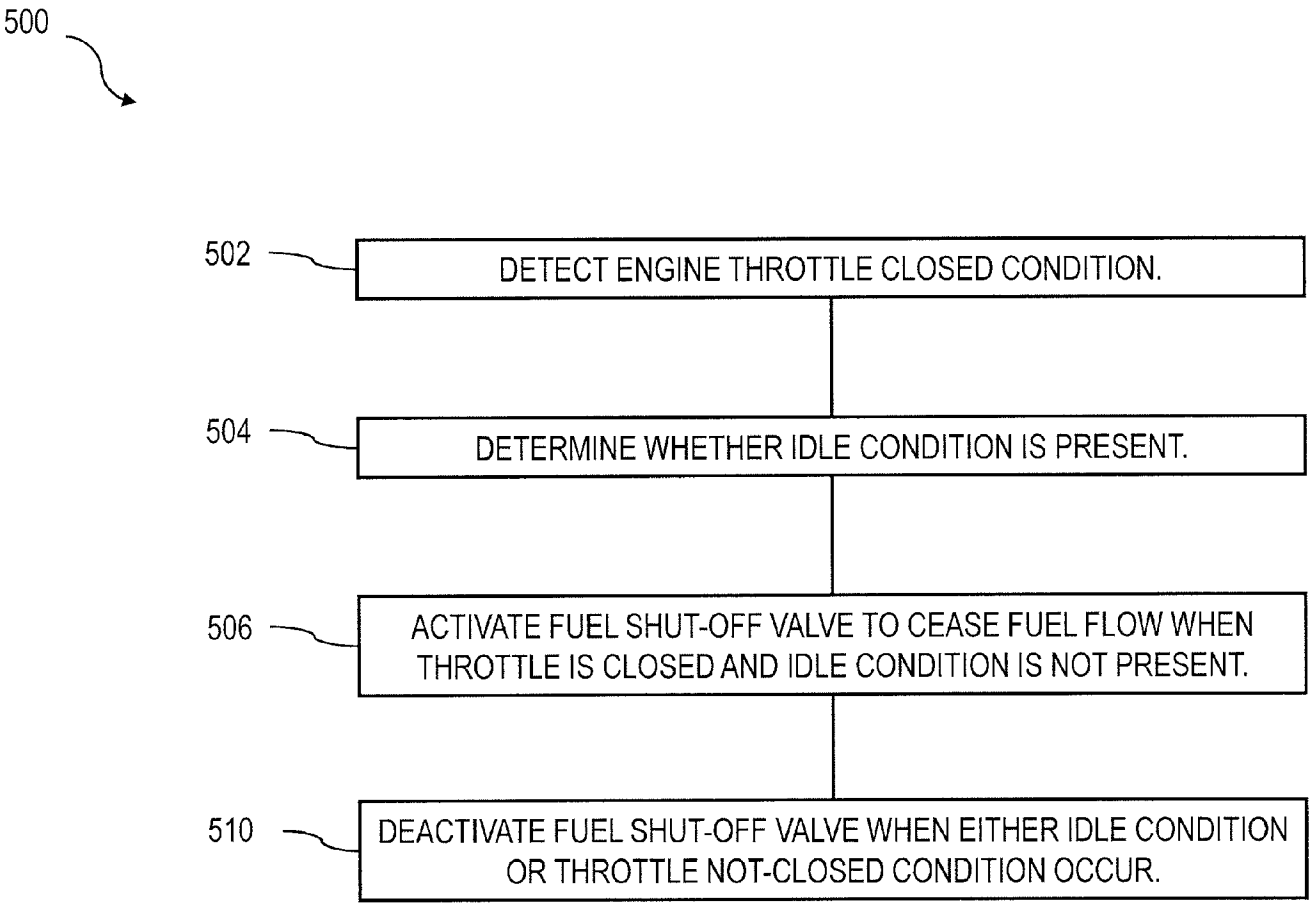
FIG. 5 is a process flow diagram illustrating aspects of a method having one or more features consistent with implementations of the current subject matter.

FIG. 5 shows a process flow chart 500 illustrating features that can be included in a method consistent with implementations of the current subject matter. At 502, a throttle closed condition of an engine can be detected, for example in one of the ways described herein or in a functionally similar or equivalent manner. This operation can be performed using an idle condition sensor 102 as discussed above, using logic within an engine control unit, and/or in a functionally similar or equivalent manner. At 504, a determination can be made whether the engine is currently at an idle condition. This operation can be performed using a throttle sensor 104 as discussed above, using logic within an engine control unit, and/or in a functionally similar or equivalent manner. When the throttle closed condition occurs in the absence of the idle condition, a fuel shut-off valve 106 can be activated at 506 to cease fuel flowing from a fuel reservoir through a fuel orifice of a carburetor into an air passage conveying air to one or more combustion chambers of the engine. When at 510 either the throttle closed condition is not present or the idle condition is present, the fuel shut-off valve 106 can be deactivated to allow fuel to flow to the fuel orifice and into the air flowing in the air passage to the combustion chamber(s) of the engine.

In still other implementations of the current subject matter, fuel can be provided to the combustion chamber(s) of a motorcycle engine through one or more fuel injectors. These one or more fuel injectors can be controlled by an engine control unit, which can cause fuel flow through the one or more fuel injectors to stop when the throttle is closed and the engine is not currently at an idle condition.

Use of a fuel shut-off system such as is discussed herein or otherwise consistent with one or more implementations of the current subject matter can provide a 10% to 20% or even greater improvement in fuel efficiency, in particular in a city-style driving cycle with a significant amount of engine deceleration events.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described above can be directed to various combinations and sub-combinations of the disclosed features and/or combinations and sub-combinations of one or more features further to those disclosed herein. In addition, the logic flows depicted in the accompanying figures and/or described herein do not necessarily require the particular order shown, or sequential order, to achieve desirable results. The scope of the following claims may include other implementations or embodiments.

What is claimed is:

1. A system comprising:

at least one sensor, the at least one sensor detecting an idle condition and a throttle closed condition for an internal combustion engine; and a fuel shut off valve, the fuel shut off valve shutting off fuel flow to a carburetor of the internal combustion engine when the throttle closed condition occurs without the idle condition and allowing fuel flow to the carburetor when either the throttle closed condition is not present or the idle condition is present.

2. A system as in claim 1, wherein the at least one sensor comprises a first sensor for detecting the idle condition and a second sensor for detecting the throttle closed condition.

3. A system as in claim 2, wherein the first sensor for detecting the idle condition comprises:

a sensing inductor positioned to react to current flowing through one or more ignition wires of the internal combustion engine;

a diode that receives and converts output from the sensing inductor to a unidirectional current;

a charge storage device that receives and stores a charge generated by the unidirectional current; and a transistor having a turn-on threshold that is exceeded by voltage on the charge storage device when a speed of the internal combustion engine is at or above a threshold engine speed indicative of the internal combustion engine not being at idle.

4. A system as in claim 3, wherein the second sensor comprises a binary throttle switch that indicates on when the throttle is closed and indicates off when the throttle is open.

5. A system as in claim 4, wherein the first sensor and the second sensor are arranged in series such that:

when the speed of the internal combustion engine is at or above the threshold engine speed, thereby causing the transistor to be turned on, and when the throttle is closed, thereby causing the binary throttle switch to indicate on, current is provided to a solenoid of the fuel shut off valve to cause the fuel shut off valve to interrupt a supply of fuel to the combustion chamber; and when the speed of the engine decreases below the threshold engine speed, or when the throttle is opened, or when the speed of the engine decreases below the threshold engine speed and the throttle is opened, the current to the solenoid is stopped and the fuel shut off valve no longer interrupts the supply of fuel.

6. A system as in claim 3, further comprising a bleed resistor tuned to cause the voltage on the charge storage device to track the engine speed.

7. A system as in claim 6, wherein the bleed resistor comprises a variable resistance such that the threshold engine speed is adjustable.

8. A system as in claim 1, wherein the at least one sensor comprises a pressure sensor.

9. A system as in claim 8, wherein the pressure sensor detects a pressure drop in an intake manifold of the internal combustion engine, the pressure drop occurring once per engine cycle for each combustion chamber in the internal combustion engine when the throttle is closed, the pressure sensor thereby providing a measure of engine speed and a detection of the throttle closed condition, the measure of engine speed being used to detect the idle condition.

10. A system as in claim 1, wherein the at least one sensor comprises a vacuum-driven diaphragm, the vacuum-driven diaphragm being positioned to have atmospheric pressure on a first side and intake manifold pressure on a manifold side opposite to the first side, the diaphragm comprising a bleed hole on the manifold side to tune the diaphragm such that the diaphragm actuates above a threshold engine speed indicative of the idle condition not being present, actuation of the diaphragm causing the fuel shut off valve to shut off the fuel flow to the carburetor.

11. A system as in claim 10, wherein the diaphragm comprises a linkage to a throttle of the internal combustion engine such that actuation of the diaphragm to cause the fuel shut off valve to shut off the fuel flow to the carburetor is allowed only with the throttle closed condition.

12. A system as in claim 1, wherein the fuel shut off valve comprises a heater and a bimetallic element, the bimetallic element comprising a flat side arranged so that the flat side is directed toward incoming air flow in the carburetor, the heater providing heat to the bimetallic element to cause the bimetallic element to straighten to cover a fuel orifice in the carburetor, current to the heater being turned on when the throttle closed condition occurs without the idle condition, thereby interrupting a flow of fuel, and turned off when at least one of the throttle closed condition is not present or the idle condition is present, thereby resuming the flow of fuel.

13. A method comprising:

detecting an engine throttle closed condition for an internal combustion engine;

determining whether an idle condition is present in the internal combustion engine;

activating a fuel shut-off valve to cease fuel flow when engine throttle closed condition exists and the idle condition is not present; and deactivating the fuel shut-off valve to resume fuel flow when either the idle condition is present or the engine throttle closed condition does not exist.

14. A method as in claim 13, wherein detecting comprises either use of a first sensor for detecting the idle condition and a second sensor for detecting the throttle closed condition or use of a single sensor for detecting both of the idle condition and the throttle closed condition.

15. A method as in claim 14, wherein the first sensor for detecting the idle condition comprises:

a sensing inductor positioned to react to current flowing through one or more ignition wires of the internal combustion engine;

a diode that receives and converts output from the sensing inductor to a unidirectional current;

a charge storage device that receives and stores a charge generated by the unidirectional current; and a transistor having a turn-on threshold that is exceeded by voltage on the charge storage device when a speed of the internal combustion engine is at or above a threshold engine speed indicative of the internal combustion engine not being at idle.

16. A method as in claim 15, wherein the second sensor comprises a binary throttle switch that indicates on when the throttle is closed and indicates off when the throttle is open.

17. A method as in claim 16, wherein the first sensor and the second sensor are arranged in series such that:

when the speed of the internal combustion engine is at or above the threshold engine speed, thereby causing the transistor to be turned on, and when the throttle is closed, thereby causing the binary throttle switch to indicate on, current is provided to a solenoid of the fuel shut off valve to cause the fuel shut off valve to interrupt a supply of fuel to the combustion chamber; and when the speed of the engine decreases below the threshold engine speed, or when the throttle is opened, or when the speed of the engine decreases below the threshold engine speed and the throttle is opened, the current to the solenoid is stopped and the fuel shut off valve no longer interrupts the supply of fuel.

18. A method as in claim 14, wherein first sensor comprises a variable resistance bleed resistor, and the method further comprises use an adjustable threshold engine speed.

19. A method as in claim 14, wherein the at least one sensor comprises a vacuum-driven diaphragm, the vacuum-driven diaphragm being positioned to have atmospheric pressure on a first side and intake manifold pressure on a manifold side opposite to the first side, the diaphragm comprising a bleed hole on the manifold side to tune the diaphragm such that the diaphragm actuates above a threshold engine speed indicative of the idle condition not being present, actuation of the diaphragm causing the fuel shut off valve to shut off the fuel flow to the carburetor.

20. A method as in claim 19, wherein the diaphragm comprises a linkage to a throttle of the internal combustion engine such that actuation of the diaphragm to cause the fuel shut off valve to shut off the fuel flow to the carburetor is allowed only with the throttle closed condition.

21. A method as in claim 13, wherein the detecting comprises detecting, with a pressure sensor, a pressure drop in an intake manifold of the internal combustion engine, the pressure drop occurring once per engine cycle for each combustion chamber in the internal combustion engine when the throttle is closed, the pressure sensor thereby providing a measure of engine speed and a detection of the throttle closed condition, the measure of engine speed being used to detect the idle condition.

22. A method as in claim 13, wherein the fuel shut off valve comprises a heater and a bimetallic element, the bimetallic element comprising a flat side arranged so that the flat side is directed toward incoming air flow in the carburetor, the heater providing heat to the bimetallic element to cause the bimetallic element to straighten to cover a fuel orifice in the carburetor, current to the heater being turned on when the throttle closed condition occurs without the idle condition, thereby interrupting a flow of fuel, and turned off when at least one of the throttle closed condition is not present or the idle condition is present, thereby resuming the flow of fuel.

* * * * *